US005782616A

United States Patent [19]

Yoo

[11] Patent Number: 5,782,616

[45] Date of Patent: Jul. 21, 1998

[54] OIL PUMP OF THE FORCED LUBRICATION SYSTEM

[75] Inventor: Sung Choon Yoo, Kyungsangnam-do, Rep. of Korea

[73] Assignee: Hyundai Motor Company, Seoul, Rep. of Korea

[21] Appl. No.: 727,296

[22] Filed: Oct. 8, 1996

[30] Foreign Application Priority Data

Oct. 11, 1995 [KR] Rep. of Korea ..... 1995-34812

[51] Int. Cl.[6] ..... F04B 17/00; F04B 21/02

[52] U.S. Cl. ..... 417/364; 417/470; 417/534; 184/6.5; 184/6.6; 184/27.1

[58] Field of Search ..... 417/364, 470, 417/534; 184/6.5, 6.6, 6.8, 18, 27.1

[56] References Cited

U.S. PATENT DOCUMENTS 1,474,769 11/1923 Dunning ..... 417/534

2,178,754 11/1939 Hennessy ..... 184/27.1

4,679,994 7/1987 Brown ..... 417/534

5,322,103 6/1994 Hudson ..... 184/27.1

*Primary Examiner*—Charles G. Freay

*Attorney, Agent, or Firm*—Finnegan,Henderson, Farabow, Garrett & Dunner, L.L.P.

[57] ABSTRACT

The present invention relates to an oil pump of the forced lubrication system in an automobile engine. The oil pump is mounted in the lower crank case, preferably at the bottom of the oil pan in order to be immersed in a lubricating oil filled therein. The oil pump of the present invention is a combination of the well known plunger type oil pump and the swash-plate pump, which has two pistons and one T-shaped operating rod incorporated therein. The outer end of the T-shaped operating rod is extended to the engine crank shaft. The outer end of the operating rod is directly coupled to the bearing load of the crank shaft, opposite to the engine connecting rod, to form a second connecting rod which allows translation of the connecting rod from rotation of the crank shaft.

2 Claims, 2 Drawing Sheets

OIL PUMP OF THE FORCED LUBRICATION SYSTEM

BACKGROUND OF THE INVENTION

1. Field of the Invention

The present invention relates to an oil pump of the forced lubrication system in an automobile engine and, more particularly, to an oil pump of a plunger type located in the lower crank case and operated with crank shaft of the engine.

2. Description of the Prior Art

Generally, the lubrication system in an automobile supplies an lubricating oil to the sliding parts of the engine cylinders as well as the rotating parts of the crank shaft and the cam shaft.

Well known lubrication system is the splash lubrication system, the forced lubrication system, and the splash and forced combination lubrication system. In these days, the forced lubrication system is widely used in a gasoline engine as the engine output and the output speed have been increased.

A conventional forced lubrication system is exemplified by attached drawing FIG. 1, in which the lubricating oil filled in an oil pan 11 is sucked in and compressed by an oil pump 12 driven by the cam shaft (not shown) to supply the oil with each lubrication part.

The oil sent by the oil pump 12 is firstly introduced to the oil gallery 17 formed in the cylinder block and located above of the crank shaft 16, and is supplied to each lubrication part such as the main bearing of the crank shaft 16.

In this lubrication system, the oil pump 12 is mounted at the outside of the lower crank case and above the oil pan 11.

Also, the inlet port of the oil pump 12 is connected with an oil strainer 13 in the oil pan 11 through a connecting pipe 14, and the outlet port of the pump 12 with the oil filter 15. The oil pressure sent from the oil filter 15 through the oil pipe 14' is normally about 2–3 kg/cm$^2$ (30–40 psi.)

However, such an oil pump that installed outside of the oil pan has drawback of insufficient oil supply at the time of engine start when the viscosity of the engine oil is increased for example when the temperature is below freezing, or the pump is at the end of its useful life. This insufficient supply of oil results in rapid abrasion of the lubrication parts in the crank case of an engine.

SUMMARY OF THE INVENTION

The present invention overcomes these and other problems and provides a novel structure of oil pump which is accommodated in the oil pan and is operably coupled to the crank shaft.

Therefore, it is an object of the present invention to provide an oil pump of a plunger type to effectively supply an engine oil when the engine is started as well when the engine oil has high viscosity.

In achieving the above objects, the oil pump according to the present invention comprises: a pump cylinder having two inlet ports and outlet ports disposed at both sides thereof respectively, and mounted at the bottom of an oil pan of an engine crankcase, both outlet ports are joined together via a connecting pipe to couple with an oil supply pipe directed to an oil filter located above the oil pan; a first one-way valve means provided at each of said inlet port for allowing the oil to flow toward the inside of said cylinder; a second one-way valve means provided at each of said outlet port for allowing the oil to flow toward the outside of said cylinder; a pair of pistons sidably mounted in said cylinder, each having a same diameter and a slant surface at one side thereof to face each other; a horizontal bar interposed between the slant surface of said pistons and having slant surfares at both ends thereof having the same slant angle as the semisurfares of said pistons; a connecting rod penetrating the top center portion of said cylinder mounted between the center portion of said horizontal bar and the bearing load of the crank shaft, to form the T-shaped pump operating rod; and compression springs provided between each of the other side of said pistons and opposing inner surface of said cylinder.

Further, said connecting rod is directly coupled to the bearing load of the crank shaft, opposite to the engine connecting rod, to form a second connecting rod which allows translation of the connecting rod in response rotation of the engine crank shaft.

BRIEF DESCRIPTION OF THE DRAWINGS

The above object and advantages of the present invention will become more apparent by describing in detail the preferred embodiment of the present invention with reference to the attached drawings in which.

DETAILED DESCRIPTION OF THE PREFERRED EMBODIMENT

Figure 2:
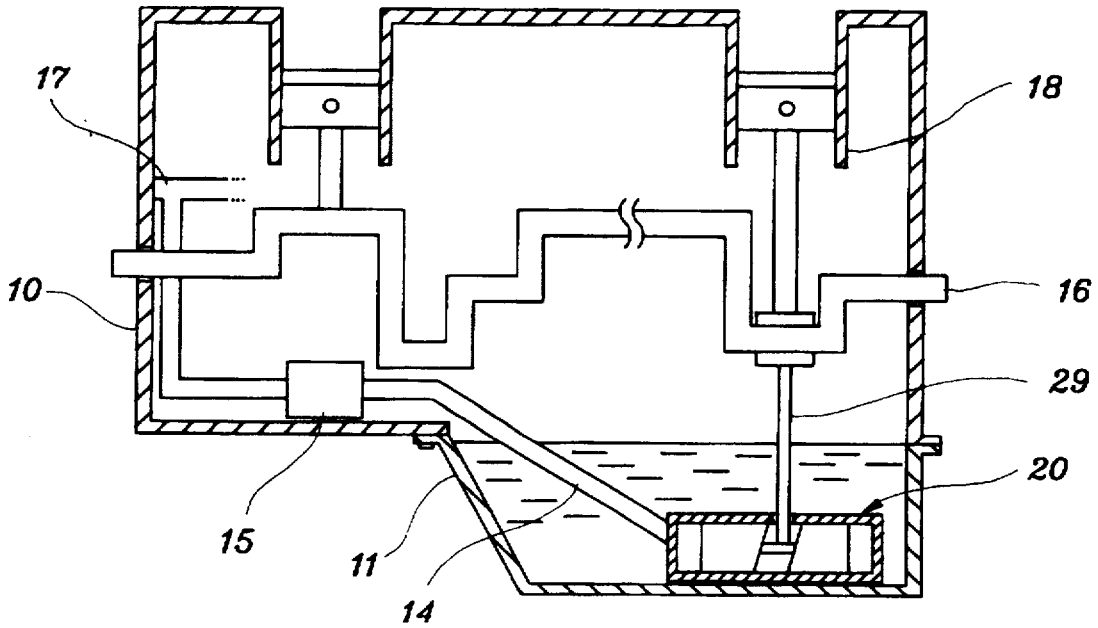
FIG. 2 is a similar view as FIG. 1 for showing an embodiment of the lubrication system which comprises an oil pump in accordance with the present invention.

Referring to FIG. 2, a forced lubrication system which includes an oil pump according to the present invention is schematically shown, in which the oil pump 20 is mounted in the lower crank case, preferably at the bottom of the oil pan 11 in order to be immersed in a lubricating oil filled therein.

Also, the outlet port of the oil pump 20 is connected with the oil filter 15 which is located at the bottom of the crank case and above the oil pan 11, through a connecting pipe 14.

Figure 1:
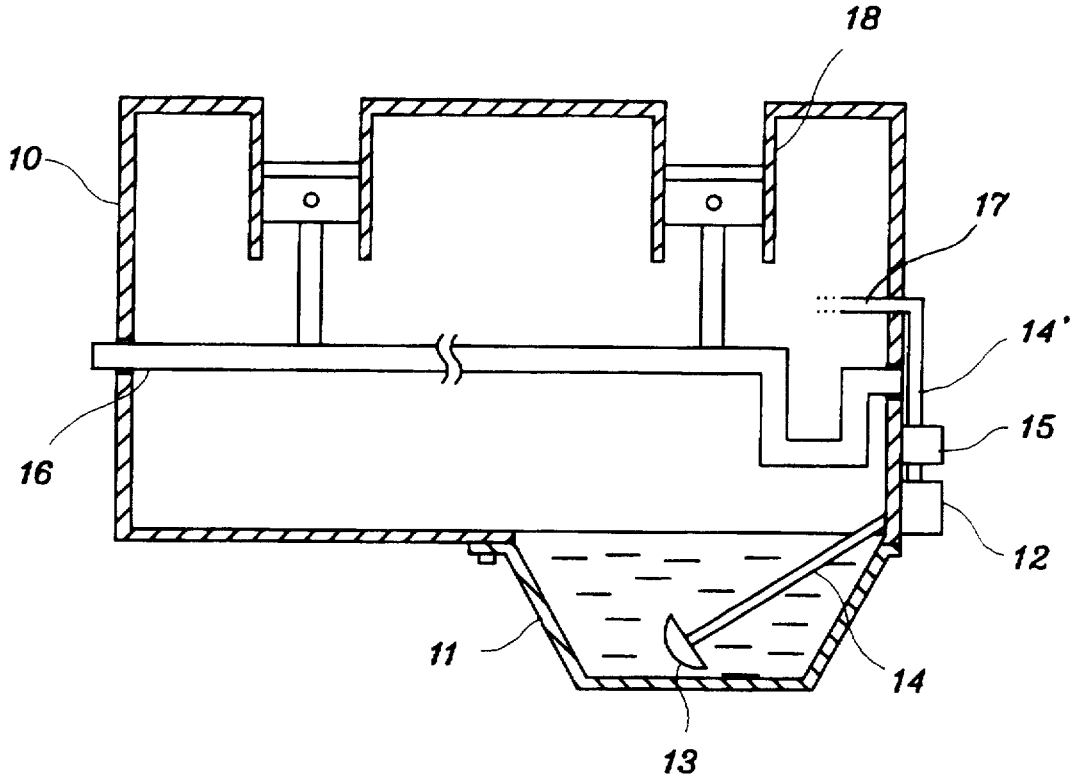
FIG. 1 PRIOR ART
FIG. 1 is a partly sectional schematic illustration of the conventional forced lubrication system in an automobile engine.

Further, in a manner similar to the lubrication system of FIG. 1, the outlet port of the oil filter 15 is connected with the main oil gallery 17 formed in the cylinder block and located above the crank shaft 16.

The oil pump 20 of the present invention is a combination of the well known plunger type oil pump and the swash-plate pump, which has two pistons and one T-shaped operating rod incorporated therein, to be described in detail hereinafter. The outer end of the T-shaped operating rod is extended to the engine crank shaft 16. The outer end of the operating rod is directly coupled to the load bearing of the crank shaft 16, on an opposite side from where the engine connecting rod is coupled, to form a second connecting rod 29, which translates as a result rotation of the crank shaft 16.

Figure 3:
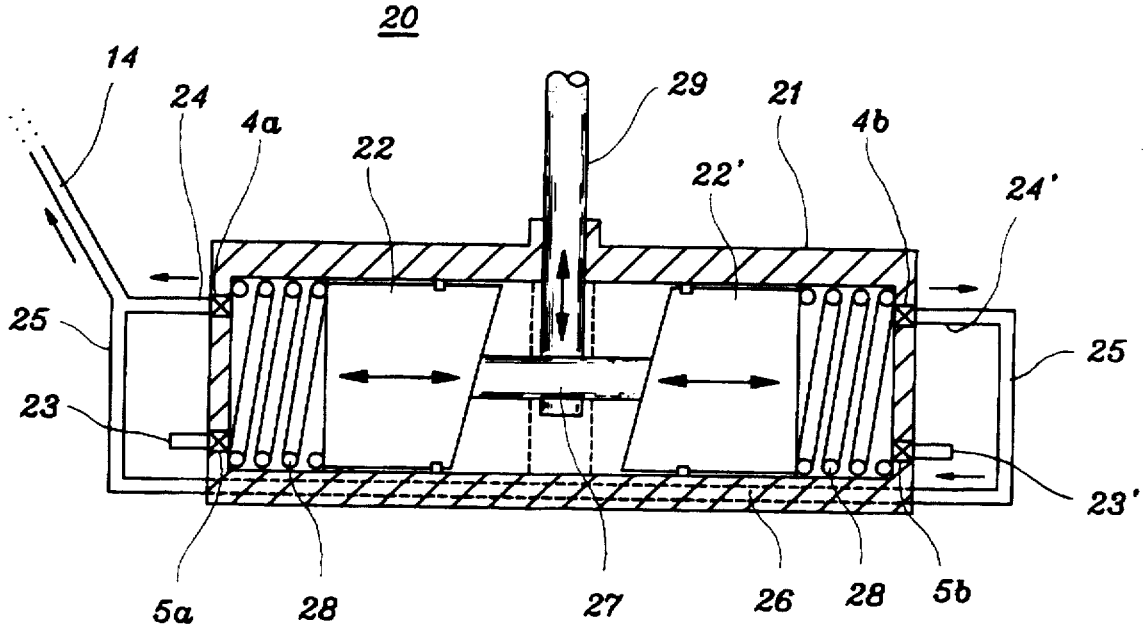
FIG. 3 is an enlarged detail of the oil pump shown in FIG. 2.

As shown in detail in FIG. 3, the oil pump 20 comprises a pump cylinder 21 having two inlet ports 23, 23' each disposed at one side thereof and two outlet ports 24, 24' also each disposed at one side thereof, and joined together by a connecting pipe 25 to connect with oil supply pipe 14.

At each of the inlet port 23, 23', there are provided an one-way check valves **5*a*, 5*b* permitting an oil flow toward the inside of the cylinder 21. Also, at the outlet ports 24, 24'**, check valves 4*a*, 4*b* are provided to permit an oil flow directed to the outside of the cylinder 21. Preferably, the check valves 4*a*,4*b* and 5*a*,5*b* are of check ball or leaf spring type.

Further, two pistons 22, 22' are provided slidably mounted inside of the cylinder 21, each having a same diameter and a slant surface at one side thereof to face each other.

Between the slant surface of the pistons 22, 22', a horizontal bar 27 is interposed. The horizontal bar 27 has slant surfaces at both ends, having the same slant angle as that of the pistons 22, 22' facing the respective end surfaces.

Further, a compression spring 28 is provided between each of the other side of the piston 22 and 22' and the opposing inner surface of the cylinder 21.

At the center portion of the horizontal bar 27, the other end of the said connecting rod 29 is coupled, penetrating the top center portion of the cylinder 21, to form the T-shaped pump operating rod.

As in the conventional lubrication system, the lubricating oil filled in the oil pan 11 is sucked in and compressed by the oil pump 20 driven by the connecting rod 29 and horizontal bar 27 to supply the oil effectively to each lubrication part in the crank case 10.

That is, when the engine is started to operate, the crank shaft 16 is rotated and the connecting rod 29 and the horizontal bar 27 moves up and down at the predetermined vertical length corresponding to the diameter of each piston 22, 22'.

The reciprocal up and down movement of the horizontal bar 27 forces the pistons 22 and 22' to move left and right reciprocally along the cylinder wall, simultaneously.

When the pistons 22 and 22' are moved toward the inside of the cylinder 21, the oil is sucked into the cylinder 21 through the check valves 5*a*, 5*b*. On the other side, when the pistons 22 and 22' are moved toward outside of the cylinder 21, the sucked oil in the cylinder is compressed and discharged through the check valves 4*a* and 4*b* of the outlet port 24, 24'.

The oil spurted from the outlet port 24' of the oil pump 20 is gathered at the other outlet port 24 by means of the connecting pipe 25, to which the oil supply pipe 14 is connected.

The discharged oil is passed through the oil filter 15 and introduced to the main oil gallery 17, and then supplied to the main bearing of the crank shaft 16 to effect the lubrication of the crank case.

As apparent from the foregoing, the oil pump of the present invention is constructed such that the pump itself is immersed in the engine lubricating oil and is directly connected by the T-shaped connecting rod to co-operate with two pistons, thereby effectively supplying the engine oil when the engine is starting even when the weather conditions are below freezing, resulting in high viscosity of the oil.

What is claimed is:

1. An oil pump of a forced lubrication system in an automobile engine comprising:

a pump cylinder having two inlet ports and outlet ports, each disposed at a respective end of the cylinder, and the cylinder being mounted at the bottom of an oil pan of an engine crankcase, the outlet ports being joined together by a connecting pipe coupled to an oil supply pipe leading to an oil filter located above the oil, pan;

a first one-way valve means provided at each inlet port for allowing oil to flow in said cylinder;

a second one-way valve means provided at each outlet port for allowing the oil to flow out of said cylinder;

a pair of pistons coaxially slidably mounted in said cylinder, the pistons having the same diameter, and facing slant surfaces in parallel, opposed relation to each other;

a horizontal bar interposed between the slant surfaces of said pistons, said bar having a slant end surface at each end, said slant end surface having a slant angle equal to that of said slant surfaces of the pistons;

a connecting rod penetrating a top center portion of said cylinder, mounted between a center portion of said horizontal bar and a load bearing of a crank shaft, to form a T-shaped pump operating rod; and a compression spring provided between each of the outer ends of said pistons and a respective opposing inner surface of said cylinder.

2. An oil pump of the forced lubrication system as claimed in claim 1, wherein said one-way valve means are formed of one of check ball valves and leaf spring valves.

* * * * *

UNITED STATES PATENT AND TRADEMARK OFFICE

CERTIFICATE OF CORRECTION

PATENT NO. : 5,782,616
DATED : July 21, 1998
INVENTOR(S) : Sung Choon YOO

It is certified that error appears in the above-identified patent and that said Letters Patent is hereby corrected as shown below:

Claim 1, col. 4, line 21, "oil, pan" should read --oil pan--.

Signed and Sealed this

Fifteenth Day of September, 1998

*Attest:*

*Attesting Officer*

BRUCE LEHMAN

*Commissioner of Patents and Trademarks*